US007628298B2

(12) United States Patent
Dewig et al.

(10) Patent No.: US 7,628,298 B2
(45) Date of Patent: Dec. 8, 2009

(54) AEROSOL OVERCAP WITH EVAPORATION VENT

(75) Inventors: Chris A. Dewig, Haubstadt, IN (US); Michael A. Marshall, Jr., Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 12/038,624

(22) Filed: Feb. 27, 2008

(65) Prior Publication Data

US 2008/0210717 A1 Sep. 4, 2008

Related U.S. Application Data

(60) Provisional application No. 60/892,147, filed on Feb. 28, 2007.

(51) Int. Cl.
*B65D 47/00* (2006.01)

(52) U.S. Cl. ..... 222/562; 222/402.13; 220/915

(58) Field of Classification Search ..... 222/562, 222/183, 108, 402.1–402.25, 649; 220/915
See application file for complete search history.

(56) References Cited

U.S. PATENT DOCUMENTS

| | | | | | |
|---|---|---|---|---|---|
| 2,961,128 | A | * | 11/1960 | Cochran | 222/182 |
| 3,738,536 | A | * | 6/1973 | Gach | 222/153.1 |
| 3,773,227 | A | * | 11/1973 | Laing et al. | 222/153.1 |
| 3,920,162 | A | * | 11/1975 | Kimura | 222/182 |
| 3,934,751 | A | * | 1/1976 | Green et al. | 220/784 |
| 3,940,015 | A | * | 2/1976 | Gili | 221/96 |
| 4,186,853 | A | * | 2/1980 | White | 222/182 |
| 4,303,175 | A | * | 12/1981 | Lux | 220/288 |
| 4,420,099 | A | * | 12/1983 | Pizzurro et al. | 222/205 |
| 5,337,912 | A | | 8/1994 | Jochem | |
| 5,584,418 | A | | 12/1996 | Schroeder et al. | |
| 5,671,853 | A | | 9/1997 | Herr | |
| 5,788,107 | A | | 8/1998 | Meyer et al. | |
| 6,112,933 | A | | 9/2000 | Meyer et al. | |

* cited by examiner

*Primary Examiner*—Lien T Ngo
(74) *Attorney, Agent, or Firm*—Barnes & Thornburg LLP

(57) ABSTRACT

A cap is configured to mount on a can to cover a product dispenser included in the can. The cap is formed to include a passage arranged to vent vapor extant in an interior region of the cap to the surroundings outside of the cap while the cap is mounted on the can.

14 Claims, 2 Drawing Sheets

FIG. 4
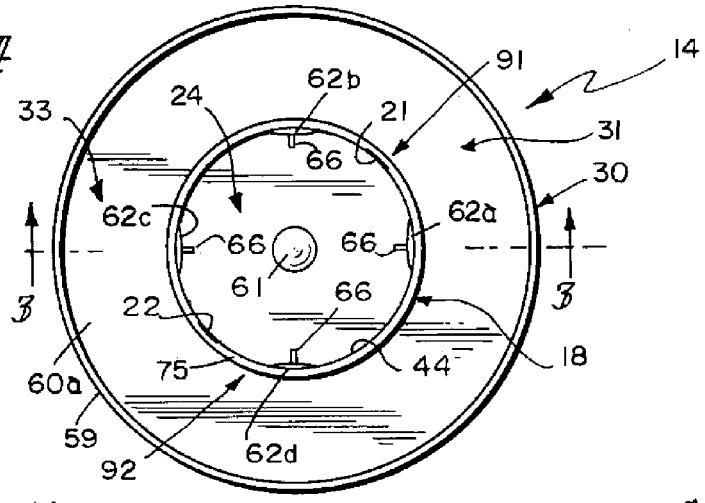
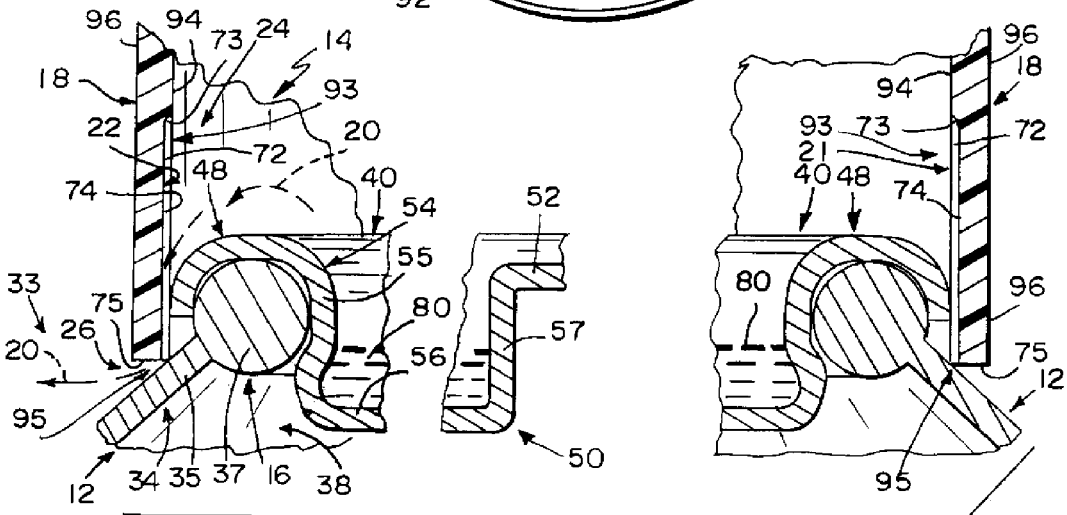
FIG. 5
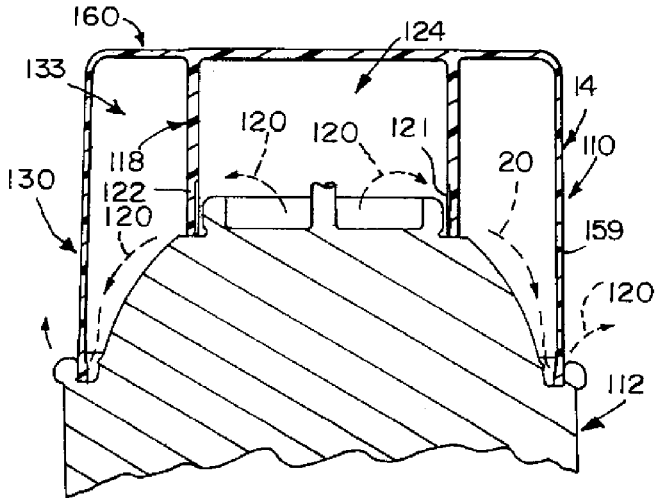
FIG. 6

AEROSOL OVERCAP WITH EVAPORATION VENT

This application claims priority under 35 U.S.C. § 119(e) to U.S. Provisional Application Ser. No. 60/892,147, filed Feb. 28, 2007, which is expressly incorporated by reference herein.

BACKGROUND

The present disclosure relates to caps for mounting on the top of aerosol cans or the like, and in particular, to an overcap for use on a necked-in can or a straight-wall can. More particularly, the present disclosure relates to an overcap provided with an evaporation vent.

Everyone has seen an aerosol can provided with a lid mounted on top of the can to cover the aerosol spray button. To release the pressurized contents of the can, it is customary to remove the lid, hold the can upright, aim the discharge opening in the right direction, and depress the aerosol spray button. Such lids are typically formed in a mold using a plastics material such as polypropylene or high-density polyethylene. The lids are usually molded to include a shell and various internal ribs and flanges. Of course, these molded lids can also be used to cover the discharge openings provided in containers other than aerosol cans.

SUMMARY

A cap in accordance with the present disclosure cooperates with a can to produce a package for storing a dispensable product. The cap is formed to include a passage channel arranged to vent vapor extant in an interior region of the cap to the surroundings outside the cap while the cap is mounted on the can.

In illustrative embodiments, the cap includes a top wall, an interior shell coupled to the underside of the top wall and configured to mate with a valve cup included in the can to mount the cap on the can, and an exterior shell including a chamber side wall coupled to a perimeter edge of the top wall and arranged to surround the interior shell. The top wall is imperforate in an illustrative embodiment. The interior shell is formed to include a vapor-vent channel to allow vapor associated with liquid collecting in the valve cup to vent to the surroundings outside of the cap through the vapor-vent channel while the cap is mounted on the can.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 4 is a bottom view of the cap of FIG. 3 showing formation of the shallow first vapor-vent channel in about a 2 o'clock position on the interior shell and the shallow second vapor-vent channel in about an 8 o'clock position on the interior shell;

FIG. 5 is an enlarged view of a portion of the package shown in FIG. 1 showing vapor flow through the shallow second vapor-vent channel formed in the interior shell of the cap when the cap is mounted on the aerosol can; and FIG. 6 is a sectional view of a package including a cap in accordance with a second embodiment mounted on a straight-wall can and provided with two shallow vapor-vent channels formed in an interior shell of the cap.

DETAILED DESCRIPTION

Figure 1:
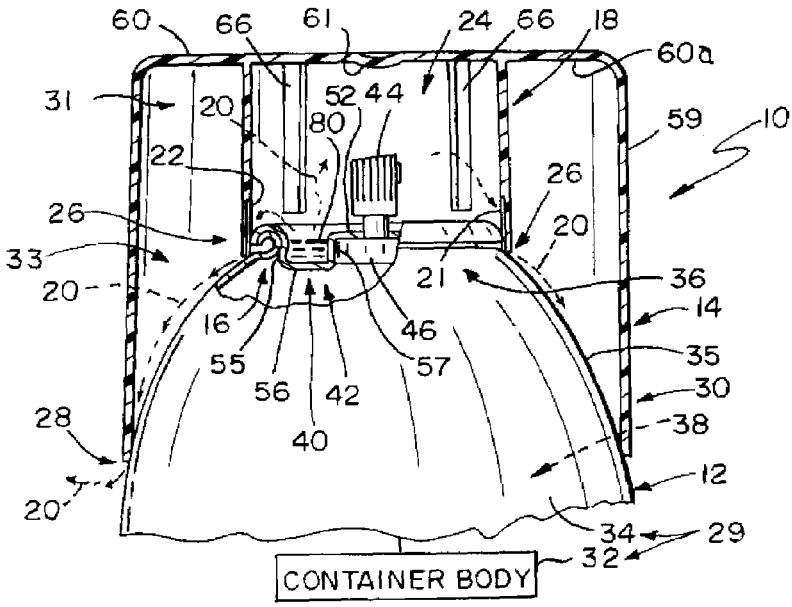
FIG. 1 is a sectional view of a package including a cap in accordance with a first embodiment of the present disclosure mounted on a valve cup of an aerosol can and showing vapor flow (in phantom) along separate paths through shallow first and second vapor-vent channels formed in a cylindrical interior shell of the cap from a liquid reservoir formed in the valve cup near a push-to-spray button to the surroundings outside the cap and showing the first vapor-vent channel on the right side of the valve cup and the second vapor-vent channel on the left side of the valve cup.

A package 10 includes an aerosol spray can 12 and a cap 14 mounted on a top end 16 of aerosol spray can 12 as suggested in FIG. 1. In an illustrative embodiment, cap 14 includes an interior shell 18 adapted to mate with top end 16 of aerosol spray can 12 and is formed to include first and second vapor-vent channels 21, 22 as suggested in FIGS. 1 and 4. When cap 14 is mounted on can 10, vapor 20 extant in an interior region 24 of interior shell 18 can flow to the surroundings outside of cap 14 as suggested in FIG. 1, in series, through vapor-vent channels 21, 22, an annular space 26 between interior shell 18 and can 12, and an annular space 28 between an exterior shell 30 of cap 14 and can 12.

Aerosol spray can 12 is a necked-in design and includes a container body 32, a container dome 34, and a top closure member 36 as shown, for example, in FIG. 1. Dome 34 is mounted on body 32 in any suitable manner. Dome 34 cooperates with body 32 to define a vessel 29 forming a product-storage chamber 38 inside can 12 as suggested in FIGS. 1 and 5. Dome 34 includes a dome-shaped wall 35 and an annular mount 37 coupled to an upper end of dome-shaped wall 35 as shown best in FIG. 5. Annular mount 37 is formed to include a mouth opening into product-storage region 38 of can 12 and is configured to mate with top closure member 36.

Top closure member 36 includes a valve cup 40 coupled to vessel 33 and a product dispenser 42 coupled to valve cup 40 as suggested in FIG. 1. Product dispenser 42 is configured to provide means for dispensing product (not shown) stored in product-storage chamber 38 of can 12 to the surroundings after removal of cap 14 from can 12. Product dispenser 42 includes a push-to-spray button 44 and a button mount 46 coupled to valve cup 40 and to button 44.

Valve cup 40 includes an annular rim 48 adapted to mate with annular mount 37 of container dome 34 as suggested, for example, in FIGS. 1 and 5. Valve cup 40 also includes an upwardly opening basin 50 surrounded by and coupled to annular rim 48 as suggested in FIG. 1. Basin 50 is formed to include an island 52 coupled to button support 46 of product dispenser 42 and an annular reservoir 54 surrounding island 52. Basin 50 includes an annular outer reservoir wall 55 coupled to annular rim 48, an annular inner reservoir wall 57 coupled to island 52, and an annular reservoir floor 56 arranged to lie between and mate with lower portions of concentric annular outer and inner reservoir walls 55, 57 as suggested in FIG. 1.

Figure 2:
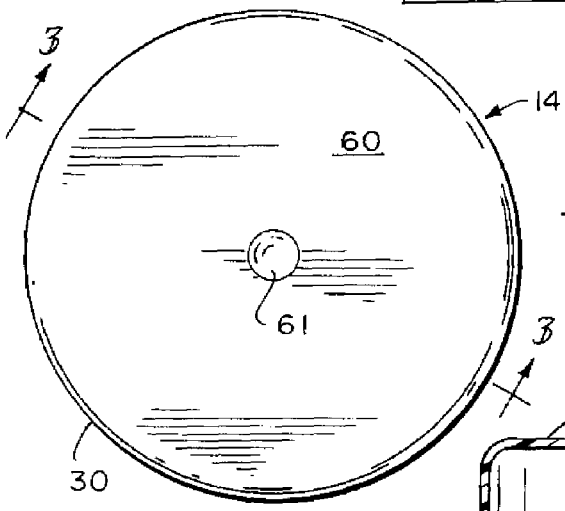
FIG. 2 is a top plan view of the cup of FIG. 2 showing that no evaporation-vent hole is formed in the top wall of the cap.
Figure 3:
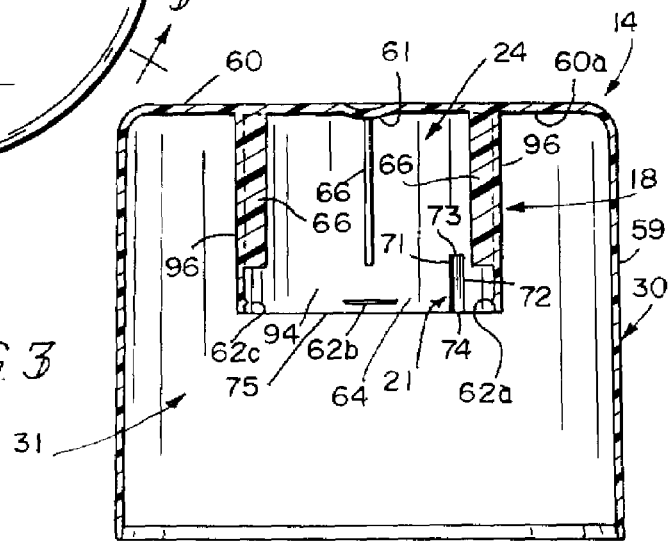
FIG. 3 is a sectional view of the cap of FIG. 1 separated from the aerosol can of FIG. 1 and taken along lines 3-3 of FIGS. 2 and 4 showing formation of a vertically extending first vapor-vent channel in an inner wall of the cylindrical interior shell of the cap along with three of the four grip flanges provided along a lower edge of the interior shell and three of the four stacking ribs located between the grip flanges and the top wall of the cap.

Cap 14 includes a round top wall 60 and a cylindrical chamber side wall 59 appended to a perimeter edge of top wall 60 and configured to define exterior shell 30 as suggested in FIGS. 1-3. Exterior shell 30 is formed to include a shell chamber 31 as suggested in FIGS. 1, 3, and 4.

Interior shell 18 is located in shell chamber 31 formed in exterior shell 30 and coupled to an underside 60*u* of top wall 60 as suggested in FIGS. 1 and 3. Round top wall 60 is imperforate in an illustrative embodiment as suggested in FIG. 2. Round top wall 60 includes a convex dimple 61 located in a center portion and arranged to extend into interior region 24 of interior shell 18. Chamber side wall 59 of exterior shell 30 and interior shell 18 are arranged to lie in concentric relation to one another, in an illustrative embodiment, as suggested in FIG. 4.

First and second vapor-vent channels 21 and 22 are formed to have vertically extending openings in inner wall 94 of interior shell 18 as suggested in FIGS. 3 and 4. Each vapor-vent channel 21, 22 is defined by a shallow depression bordered by, for example, two long side-wall edges 71, 72, one short end-wall edge 73, and one rectangular, flat, channel floor 74. Side-wall edges 71, 72 and channel floor 74 cooperate to form a downwardly facing opening 95 in a bottom edge 75 of interior shell 18 as suggested in FIG. 5. Vapor 20 extant in interior region 24 of interior shell 18 can flow out of interior region 24 through vapor-vent channels 21, 22 to the surroundings outside of cap 14 as suggested in FIGS. 1 and 5 while cap 14 is mounted on can 12.

In an illustrative embodiment, four grip flanges 62*a, b, c*, and *d* are appended to a curved inner surface 64 of interior shell 18. Each grip flange 62 is arranged to extend in a radially inward direction to mate with an edge of annular rim 48 of valve cup 40 to provide means for retaining cap 14 temporarily in a mounted position on can 12 as suggested in FIG. 1 until it is later removed from can 12 by a consumer. Four uniformly and circumferentially spaced-apart grip flanges 62 are coupled to interior shell 18 as suggested, for example, in FIG. 4.

Also in an illustrative embodiment, four vertically extending stacking ribs 66 are appended to curved inner surface 64 of interior shell 18. Each rib 66 is aligned with a companion grip flange 62 and arranged to extend in a radially inward direction as suggested in FIGS. 1, 2, and 4. Four stacking ribs 66 are uniformly and circumferentially spaced-apart along inner surface 64 of interior shell 18 as suggested in FIG. 4.

Liquid 80 can collect in reservoir 54 formed in basin 50 of valve cup 40 as suggested in FIGS. 1 and 5 for various reasons. It is common to spray an aerosol container with a cleaning liquid such as water to clean the container after it has been filled but before an overcap is mounted on the container. Although air jets often are used to remove any water residue from the container, a small quantity of water may remain in the valve cup. When cap 14 is mounted on container 12, any water or other liquid that has collected in reservoir 54 of basin 50 can evaporate and leave interior chamber 24 as a vapor 20 flowing through first and second vapor-vent channels 21, 22 and through annular spaces 26 and 28 to the surroundings outside of package 10 while cap 14 is mounted on aerosol can 12 as suggested, for example, in FIGS. 1 and 5.

A package 110 includes a straight-wall aerosol spray can 112 and a cap 114 mounted on a top end 116 of can 112 as suggested in FIG. 6. Cap 114 includes an interior shell 118 and an exterior shell 130 including imperforate round top wall 160 and a chamber side wall 159. Several grip flanges (not shown) similar to grip flanges 62 shown in FIG. 3 are provided oil a curved interior surface of interior shell 118. Cap 114 includes vapor-collection chamber 124 and vapor-discharge chamber 133 as suggested in FIG. 6.

Interior shell 118 is formed to include first and second vapor-vent channels 121, 122 as shown in FIG. 6. Vapor 120 extant in interior region 114 of interior shell 118 can flow out of interior region 124 through vapor-vent channels 121, 122 to the surroundings outside of cap 114 as suggested in FIG. 6 while cap 114 is mounted on straight-wall can 112 as suggested in FIG. 6.

Package 10 includes a can 12 and a cap 14 as shown, for example, in FIG. 1. Can 12 including valve cup 40 and product dispenser 42 coupled to valve cup 40 and configured to dispense product stored in product-storage chamber 38 formed in can 12. Valve cup 40 is formed to include a reservoir 54 configured to collect liquid 80 applied to can 12. Cap 14 includes an exterior shell 30 having a top wall 60 and a chamber side wall 59 coupled to top wall 60 to form a shell chamber 31 and an interior shell 18 located in shell chamber 31 and coupled to top wall 60 of exterior shell 30 as shown, for example, in FIGS. 1, 3, and 4.

Top wall 60 is imperforate and cooperates with interior shell 18 to form a vapor-collection space 24 situated to receive vapor 20 generated by evaporation of any liquid 80 remaining in reservoir 54 formed in valve cup 40 after cap 14 is mounted on can 12 to cover valve cup 40 as suggested in FIG. 1. Interior shell 18 is formed to include vent means for venting vapor 20 extant in vapor-collection space 24 into a vapor-discharge chamber 33 located in shell chamber 31 between interior shell 18 and chamber side wall 59 for subsequent discharge to the atmosphere through a gap 78 formed between can 12 and chamber side wall 59 of exterior shell 30 without passing through an aperture (not shown) formed in top wall 60 of cap 14 while cap 14 is mounted on can 12 to cover valve cup 40 as suggested in FIG. 1. The vent means includes first and second vapor-vent channels 21, 22 formed in interior shell 18.

Cap 14 further includes first and second grip flanges 62*a*, 62*b* coupled to an inner wall 94 of interior shell 18 as shown in FIGS. 3 and 4 and configured to mate with valve cup 40 to retain cap 14 in a mounted position on cap 14 as suggested in FIG. 1. First and second grip flanges 62*a*, 62*b* are arranged to lie in spaced-apart location to one another to locate first vapor-vent channel 21 therebetween as shown in FIGS. 3 and 4. Cap 14 further includes third and fourth grip flanges 62*c*, 62*d* coupled to inner wall 94 of interior shell 18 and configured to mate with valve cup 40 to retain cap 14 in the mounted position on can 12. Third and fourth grip flanges 62*a*, 62*d* are arranged to lie in spaced-apart relation to one another to locate second vapor-vent channel 22 therebetween as suggested in FIG. 4.

First and second grip flanges 62*a*, 62*b* are arranged to lie in spaced-apart relation to one another to define a first space 91 therebetween and a separate second space 92 therebetween as suggested in FIG. 4. First vapor-vent channel 21 is formed in interior shell 18 to lie in first space 91. Second vapor-vent channel 22 is formed in interior shell 18 to lie in second space 92.

First vapor-vent channel 21 is formed to have a vertically extending opening 93 in inner wall 94 of interior shell 18 extending from, as suggested in FIG. 5, an outer rim 48 of valve cup 40 in a direction toward top wall 60 of exterior shell 30. First vapor-vent channel 21 is defined by two long side-wall edges 71, 72, one short end-wall edge 73, and one channel floor 74 included in interior shell 18. Long side-wall edges 71, 72 and channel floor 74 cooperate to form a downwardly facing opening 95 in a bottom edge 75 of interior shell 18 as suggested in FIG. 5.

Valve cup 40 includes a basin 50 formed to include reservoir 54 and an annular rim 48 coupled to and arranged to surround basin 50. Channel floor 74 is arranged to lie in spaced-apart relation to annular rim 48 of valve cup 40 to allow vapor 20 extant in vapor-collection space 24 to flow along a path between channel floor 74 and annular rim 48 in a direction toward gap 28 formed between can 12 and chamber side wall 59 of exterior shell 30 as suggested in FIG. 1.

Interior shell 18 includes a cylindrical inner wall surrounding valve cup 40 as suggested in FIG. 1. First vapor-vent channel 21 defines a side opening 93 facing toward valve cup 40 and interrupting the cylindrical inner wall 94 of interior shell 18 as suggested in FIG. 5. Interior shell 18 includes two side-wall edges 71, 72 arranged to lie in spaced-apart relation to one another to define side opening 93 of first vapor vent channel 21 therebetween. Interior shell 18 includes an exterior wall 96 arranged to cooperate with chamber side wall 59 and a portion of top wall 60 to define vapor-discharge chamber as suggested in FIG. 1. Interior shell 18 also includes a channel floor 74 coupled to two side-wall edges 71, 72 and arranged to lie therebetween and in a space between exterior wall 96 of interior shell 18 and side opening 93 of first vapor-vent channel 21 formed in inner wall 94 of interior shell 18.

Interior shell 18 is coupled to an underside 60*u* of imperforate top wall 60 and configured to mate with valve cup 40 included in can 12 to mount cap 14 on can 12. Chamber side wall 59 of exterior shell 30 is coupled to a perimeter edge of imperforate top wall 60 and arranged to surround interior shell 18 as suggested in FIGS. 1 and 4. Interior shell 18 is formed to include a first vapor-vent channel 21 to allow vapor 20 associated with liquid 80 collecting in valve cup 40 to vent its surroundings outside of cap 12 through first vapor-vent channel 21 while cap 14 is mounted on can 12 as suggested in FIG. 1.

Can 12 includes a vessel 29 formed to include a product-storage chamber 38 and a top closure member 36 coupled to a body 32 in vessel 29 to close an opening into product-storage chamber 38. Top closure member 36 includes a valve cup 40 coupled to vessel 29 and a product dispenser 42 mounted on valve cup 40 and configured to dispense product stored in product-storage chamber 38 to the surroundings.

Interior shell 18 includes an outer wall 96 facing toward exterior shell 30 and cooperating with chamber side wall 59 and a portion of top wall 60 to form a vapor-discharge chamber 33 therebetween as suggested in FIG. 1. Interior shell 18 also includes an inner wall 94 facing away from outer wall 96 and cooperating with a portion of imperforate top wall 60 to form a vapor-collection space 24 situated to receive vapor 20 generated by evaporation of any liquid 80 remaining in a reservoir 54 formed in valve cup 40 after cap 14 is mounted on can 12 to cover valve cup 40. Interior shell 18 also includes a bottom edge 75 interconnecting inner and outer walls 94, 96 of interior shell 18.

Interior shell 18 also includes a channel inlet 93 opening into vapor-collection space 24, a channel outlet 95 opening into vapor-discharge chamber 33, and a first vapor-vent channel 21. First vapor-vent channel 24 is arranged to extend between and interconnect channel inlet 93 and channel outlet 95 to allow flow of vapor 20 from vapor-collection space 24 to vapor-discharge space 33 therethrough while cap 14 is mounted on can 12 to cover valve cup 40. In an illustrative embodiment, channel inlet 93 is formed in inner wall 94 of interior shell 18 and channel outlet 95 is formed in bottom edge 75 of interior shell 18 as suggested in FIG. 5.

The invention claimed is:

1. A package for storing a dispensable product, the package comprising a can including a valve cup and a product dispenser coupled to the valve cup and configured to dispense product stored in a product-storage chamber formed in the can, the valve cup being formed to include a reservoir configured to collect liquid applied to the can, and a cap including an exterior shell having a top wall and a chamber side wall coupled to the top wall to form a shell chamber and an interior shell located in the shell chamber and coupled to the top wall of the exterior shell, wherein the top wall is imperforate and cooperates with the interior shell to form a vapor-collection space situated to receive vapor generated by evaporation of any liquid remaining in the reservoir formed in the valve cup after the cap is mounted on the can to cover the valve cup and the interior shell is formed to include vent means for venting vapor extant in the vapor-collection space into a vapor-discharge chamber located in the shell chamber between the interior shell and the chamber side wall for subsequent discharge to the atmosphere through a gap formed between the can and the chamber side wall of the exterior shell while the cap is mounted on the can to cover the valve cup.

2. A package for storing a dispensable product, the package comprising a can including a valve cup and a product dispenser coupled to the valve cup and configured to dispense product stored in a product-storage chamber formed in the can, the valve cup being formed to include a reservoir configured to collect liquid applied to the can, a cap including an exterior shell having a top wall and a chamber side wall coupled to the top wall to form a shell chamber and an interior shell located in the shell chamber and coupled to the top wall of the exterior shell, wherein the top wall is imperforate and cooperates with the interior shell to form a vapor-collection space situated to receive vapor generated by evaporation of any liquid remaining in the reservoir formed in the valve cup after the cap is mounted on the can to cover the valve cup and the interior shell is formed to include vent means for venting vapor extant in the vapor-collection space into a vapor- discharge chamber located in the shell chamber between the interior shell and the chamber side wall for subsequent discharge to the atmosphere through a gap formed between the can and the chamber side wall of the exterior shell while the cap is mounted on the can to cover the valve cup, and wherein the vent means includes a first vapor-vent channel formed in the interior shell, and the first vapor-vent channel includes a vertical wall shaped to force the vapor downwardly toward the can and outwardly away from the can.

3. The package of claim 2, wherein the cap further includes first and second grip flanges coupled to an inner wall of interior shell and configured to mate with the valve cup to retain the cap in a mounted position on the cap and the first and second grip flanges are arranged to lie in spaced-apart location to one another to locate the first vapor-vent channel therebetween.

4. The package of claim 3, wherein the vent means further includes a second vapor-vent channel formed in the interior shell, the cap further includes third and fourth grip flanges coupled to the inner wall of the interior shell and configured to mate with the valve cup to retain the cap in the mounted position on the can, and the third and fourth grip flanges are arranged to lie in spaced-apart relation to one another to locate the second vapor-vent channel therebetween.

5. The package of claim 3, wherein the first and second grip flanges are arranged to lie in spaced-apart relation to one another to define a first space therebetween and a separate second space therebetween, the vent means further includes a second vapor-vent channel formed in the interior shell, the first vapor-vent channel is formed in the interior shell to lie in the first space, and the second vapor-vent channel is formed in the interior shell to lie in the second space.

6. A package for storing a dispensable product the package comprising a can including a valve cup and a product dispenser coupled to the valve cup and configure to dispense product stored in a product-storage chamber formed in the can, the valve cup being formed to include a reservoir configured to collect liquid applied to the can, a cap including an exterior shell having a top wall and a chamber side wall coupled to the top wall to form a shell chamber and an interior shell located in the shell chamber and coupled to the top wall of the exterior shell, wherein the top wall is imperforate and cooperates with the interior shell to form a vapor-collection space situated to receive vapor generated by evaporation of any liquid remaining in the reservoir formed in the valve cup after the cap is mounted on the can to cover the valve cup and the interior shell is formed to include vent means for venting vapor extant in the vapor-collection space into a vapor-discharge chamber located in the shell chamber between the interior shell and the chamber side wall for subsequent discharge to the atmosphere through a gap formed between the can and the chamber side wall of the exterior shell while the cap is mounted on the can to cover the valve cup, wherein the vent means includes a first vapor-vent channel formed in the interior shell, and wherein the first vapor-vent channel is formed to have a vertically extending opening in an inner wall of the interior shell extending from an outer rim of the valve cup in a direction toward the top wall of the exterior shell.

7. A package for storing a dispensable product, the package comprising a can including valve cup and a product dispenser coupled to the valve cup and configured to dispense product stored in a product-storage chamber formed in the can, the valve cup being formed to include a reservoir configured to collect liquid applied to the can, a cap including an exterior shell having a too wall and a chamber side wall coupled to the top wall to form a shell chamber and an interior shell located in the shell chamber and coupled to the top wall of the exterior shell, wherein the top wall is imperforate and cooperates with the interior shell to form a vapor-collection space situated to receive vapor generated by evaporation of any liquid in the reservoir formed in the valve cup after the cap is mounted on the can to cover the valve cup and the interior shell is formed to include vent means for venting vapor extant in the vapor-collection space into a vapor-discharge chamber located in the shell chamber between the interior shell and the chamber side wall for subsequent discharge to the atmosphere through a gap formed between the can and the chamber side wall of the exterior shell while the cap is mounted on the can to cover the valve cup, wherein the vent means includes a first vapor-vent channel formed in the interior shell, and wherein the first vapor-vent channel is defined by two long side-wall edges, one short end-wall edge, and one channel floor included in the interior shell.

8. The package of claim 7, wherein the two long side-wall edges and the channel floor cooperate to form a downwardly facing opening in a bottom edge of the interior shell.

9. The package of claim 7, wherein the valve cup includes a basin formed to include the reservoir and an annular rim coupled to and arranged to surround the basin and the channel floor is arranged to lie in spaced-apart relation to the annular rim of the valve cup to allow vapor extant in the vapor-collection space to flow along a path between the channel floor and the annular rim in a direction toward the gap formed between the can and the chamber side wall of the exterior shell.

10. A package for storing a dispensable product, the package comprising a can including a valve cup and a product dispenser coupled to the valve cup and configured to dispense product stored in a product-storage chamber formed in the can, the valve being formed to include a reservoir configured to collect liquid applied to the can, a cap including an exterior shell having a top wall and a chamber side wall coupled to the top wall to form a shell chamber and an interior shell located in the shell chamber and coupled to the top wall of the exterior shell, wherein the top wall is imperforate and cooperates with the interior shell to form a vapor-collection space situated to receive vapor generated by evaporation of any liquid remaining in the reservoir formed in the valve cup after the cay is mounted on the can to cover the valve cup and the interior shell, is formed to include vent means for venting vapor extant in the vapor-collection space into a vapor-discharge chamber located in the shell chamber between the interior shell and die chamber side wall for subsequent discharge to the atmosphere through a gap formed between the can and the chamber side wall of the exterior shell while the cap is mounted on the can to cover the valve cup, wherein the vent means includes a first vapor-vent channel formed in the interior shell, and wherein the interior shell includes a cylindrical inner wall surrounding the valve cup and the first vapor-vent channel defines a side opening facing toward the valve cup and interrupting the cylindrical inner wall of the interior shell.

11. The package of claim 10, wherein the interior shell includes two side-wall edges arranged to lie in spaced-apart relation to one another to define the side opening of the first vapor vent channel therebetween.

12. The package of claim 11, wherein the interior shell includes an exterior wall arranged to cooperate with the chamber side wall and a portion of the top wall to define the vapor-discharge chamber and the interior shell also includes a channel floor coupled to the two side-wall edges and arranged to lie therebetween and in a space between the exterior wall of the interior shell and the side opening of the first vapor-vent channel formed in the inner wall of the interior shell.

13. A package for storing a dispensable product, the package comprising a can including a valve cup and a product dispenser coupled to the valve cup and configured to dispense product stored in a product-storage chamber formed in the can, the valve cup being formed to include a reservoir configured to collect liquid applied to the can, a cap including an imperforate top wall, an interior shell coupled to an underside of the imperforate top wall and configured to mate with the valve cup included in the can to mount the cap on the can, and a chamber side wall coupled to a perimeter edge of the imperforate top wall and arranged to surround the interior shell, and wherein the interior shell is formed to include a vapor-vent channel to allow vapor associated with liquid collecting in the valve cup to vent to surroundings outside of the cap through the first vapor-vent channel while the cap is mounted on the can, and wherein the vapor-vent channel includes a channel outlet formed in a bottom edge of the interior shell.

14. A package for storing a dispensing product, the package comprising a can including a vessel formed to include a product-storage chamber and a top closure member coupled to the body to close an opening into the product-storage chamber, the top closure member including a valve cup coupled to the vessel and a product dispenser mounted on the valve cup and configured to dispense product stored in the product-storage chamber to the surroundings, a cap including an imperforate top wall, an interior shell coupled to an underside of the imperforate top wall and configured to mate with the valve cup included in the can to mount the cap on the can, and a chamber side wall coupled to a perimeter edge of the imperforate top wall and arranged to surround the interior shell, wherein the interior shell includes an outer wall facing toward the exterior shell and cooperating with the chamber side wall and a portion of the top wall to form a vapor-discharge chamber therebetween, an inner wall facing away from the outer wall and cooperating with a portion of the imperforate top wall to form a vapor-collection space situated to receive vapor generated by evaporation of any liquid remaining in a reservoir formed in the valve cup after the cap is mounted on the can to cover the valve cup, a bottom edge interconnecting the inner and outer walls of the interior shell, a channel inlet opening into the vapor-collection space, a channel outlet opening into the vapor-discharge chamber, and a first vapor-vent channel extending between and interconnecting the channel inlet and the channel outlet to allow flow of vapor from the vapor-collection space to the vapor-discharge space therethrough while the cap is mounted on the can to cover the valve cup, and wherein the channel inlet is formed in the inner wall of the interior shell and the channel outlet is formed in the bottom edge of the interior shell.

* * * * *